US005833086A

United States Patent [19]

Kaufhold

[11] Patent Number: 5,833,086

[45] Date of Patent: Nov. 10, 1998

[54] ALLIANCE COUPLER LOCK LIFTER SECURING ARM

[75] Inventor: Horst T. Kaufhold, Aurora, Ill.

[73] Assignee: Amsted Industries Incorporated, Chicago, Ill.

[21] Appl. No.: 967,873

[22] Filed: Nov. 12, 1997

[51] Int. Cl.[6] ..... B61G 3/24

[52] U.S. Cl. ..... 213/148

[58] Field of Search ..... 213/145, 146, 213/147, 148

[56] References Cited

U.S. PATENT DOCUMENTS

| | | | |
|---|---|---|---|
| 1,612,775 | 12/1926 | Kelso . | |
| 3,258,132 | 6/1966 | Metzger et al. | 213/100 |
| 3,433,369 | 3/1969 | Metzger et al. | 213/148 |
| 4,084,705 | 4/1978 | Oshinsky et al. | 213/145 |
| 4,172,530 | 10/1979 | Altherr et al. | 213/148 |
| 4,438,854 | 3/1984 | Baughman et al. | 213/147 |
| 4,466,546 | 8/1984 | Altherr et al. | 213/148 |

OTHER PUBLICATIONS

Car & Locomotive Cyclopedia, Centennial Edition (1974) from the Association of American Railroads—Mechanical Division, pp. S8–3, S8–4, S8–8, S8–14, S8–15 and S8–17.

User's Guide published by American Steel Foundries for couplers and yokes.

Page Two from "The Alliance Coupler System" published by AMSTED Industries International.

Illustrative Discussion of Type "F" Couplers.

*Primary Examiner*—S. Joseph Morano

*Attorney, Agent, or Firm*—Edward J. Brosius; F. S. Gregorczyk; Stephen J. Manich

[57] ABSTRACT

A latch lock mechanism for a railcar rotary-dump coupler is provided for an Alliance coupler having a more narrow inner housing cavity for the coupling mechanism than the standard coupler housing chamber, and the latch is operable to extend from a locklift assembly at a coupler and railcar inverted position to contact a top wall recess of the cavity to constrain the locklift assembly from movement past the lock thrower to thereby constrain movement of the lock thrower and coupler head, which latch maintains the coupler in a closed or coupled state at the inverted position.

7 Claims, 6 Drawing Sheets

ALLIANCE COUPLER LOCK LIFTER SECURING ARM

BACKGROUND OF THE INVENTION

1. Field of the Invention

The present invention relates to railroad car couplers and particularly to rotary couplers of the Alliance type. More specifically, a latching apparatus is disclosed for inhibiting release or displacement of the coupling mechanism especially at the inverted position of the coupler and railcar during discharge of the railcar lading.

2. Prior Art

Railroad car couplers are utilized to connect or join adjacent railcars. These couplers are found on freight cars and passenger cars. The freight car couplers include coupling apparatus for articulated connectors and rotary dump style couplers. Couplers generally include a coupler head, a knuckle and a knuckle pivot pin along with an internal mechanism with a lock and a rotary locklift arrangement. The internal mechanism is actuable to move the knuckle to an open position. The coupling assembly of rotary dump style, or rotary, couplers is inverted along with the railcar during the lading discharge operation.

In Association of American Railroad (AAR) approved rotary dump couplers, a latch stop mechanism could be utilized within the housing or coupler head to inhibit inadvertent release of the lock due to movement of the knuckle thrower. However, in the AAR coupler head, the mechanism and head size provide an adequate internal-cavity space or volume to accommodate a relatively large-sized latch-stop apparatus, as well as the requisite operating space for such apparatus. In the Alliance style rotary-dump couplers, the cavity operating space for the internal mechanism is both narrow and limited, as a consequence, the AAR latching apparatus cannot be utilized within the coupler head. It is known that the external conformation of the Alliance coupler head is different than the AAR coupler head, and that the internal cavity for the Alliance head is not the same in size or configuration as the AAR internal cavity. Both styles of couplers include anti-creep devices to inhibit inadvertent uncoupling from coupler actions during normal, upright operation of the railcar and coupler.

Upon a railcar entering a dump or unload station, the car is rotated toward an upside down or inverted position to produce a gravity release of its contents or lading. During this rotation, the car rotates about its front rotary coupler while the opposite or rear fixed coupler rotates with the car. Under these operating conditions, AAR Type E or Type F couplers should not uncouple when rotated, but uncoupling has inadvertently occurred.

Prevention of such inadvertent release of a coupler has been accommodated by the incorporation of various lock-securing devices within a coupler head. These lock-securing devices are used to limit movement of the lock and thereby maintain the knuckle in a locked position when the coupler has been inverted. In a coupler upright position, the lock-securing devices allow normal coupler operation.

A device for the prevention of coupler unlocking is disclosed in U.S. Pat. No. 1,612,775 to Kelso for a now obsolete, Type D coupler. Similarly, an anti-unlocking device for a standard AAR Type F coupler is taught in U.S. Pat. No. 3,433,369 to Metzger et al. A double-latch, anti-unlocking apparatus for a rotary coupler is provided in U.S. Pat. No. 4,172,530 to Altherr et al.. However, all of these assemblies are not appropriate or adequate for the limited internal space in the Alliance coupler.

SUMMARY OF THE INVENTION

The present invention provides a locklifter latching operator for securing the locklifter, and consequently the coupler knuckle, during inverted lading discharge of a railcar with a rotary coupler. The latch provides a positive mechanism for maintaining the knuckle thrower and locklifter in the locked position during rotation of the railcar and coupler to the inverted position. The latch in the coupler head cavity is connected to the upper end of the locklifter and pivotable about a pin, which permits free rotation of the latch to extend from the locklifter end to mechanically contact the cavity upper wall. The extended arm nesting against the upper wall inhibits movement of the locklifter and, consequently, the knuckle thrower and knuckle. Therefore, the knuckle remains in the locked and secured position during inversion of the railcar and coupler.

BRIEF DESCRIPTION OF THE DRAWING

In the several figures of the drawing, like reference numerals identify like components, and in those drawings.

DETAILED DESCRIPTION OF THE PREFERRED EMBODIMENT

Figure 1:
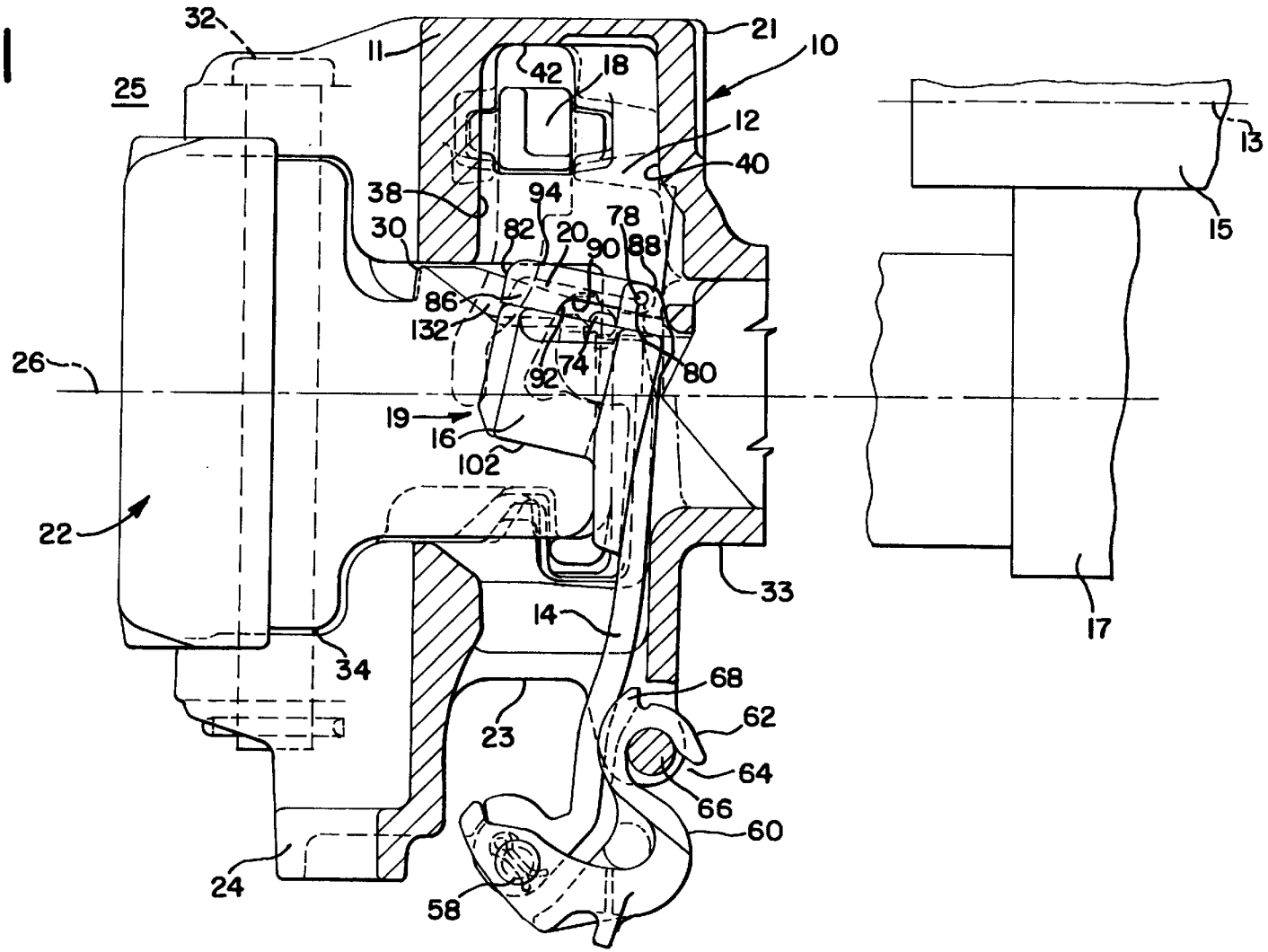
FIG. 1 is a side elevational view in partial cross-section of an upright Alliance coupler with the knuckle and lock in the locked position.
Figure 2:
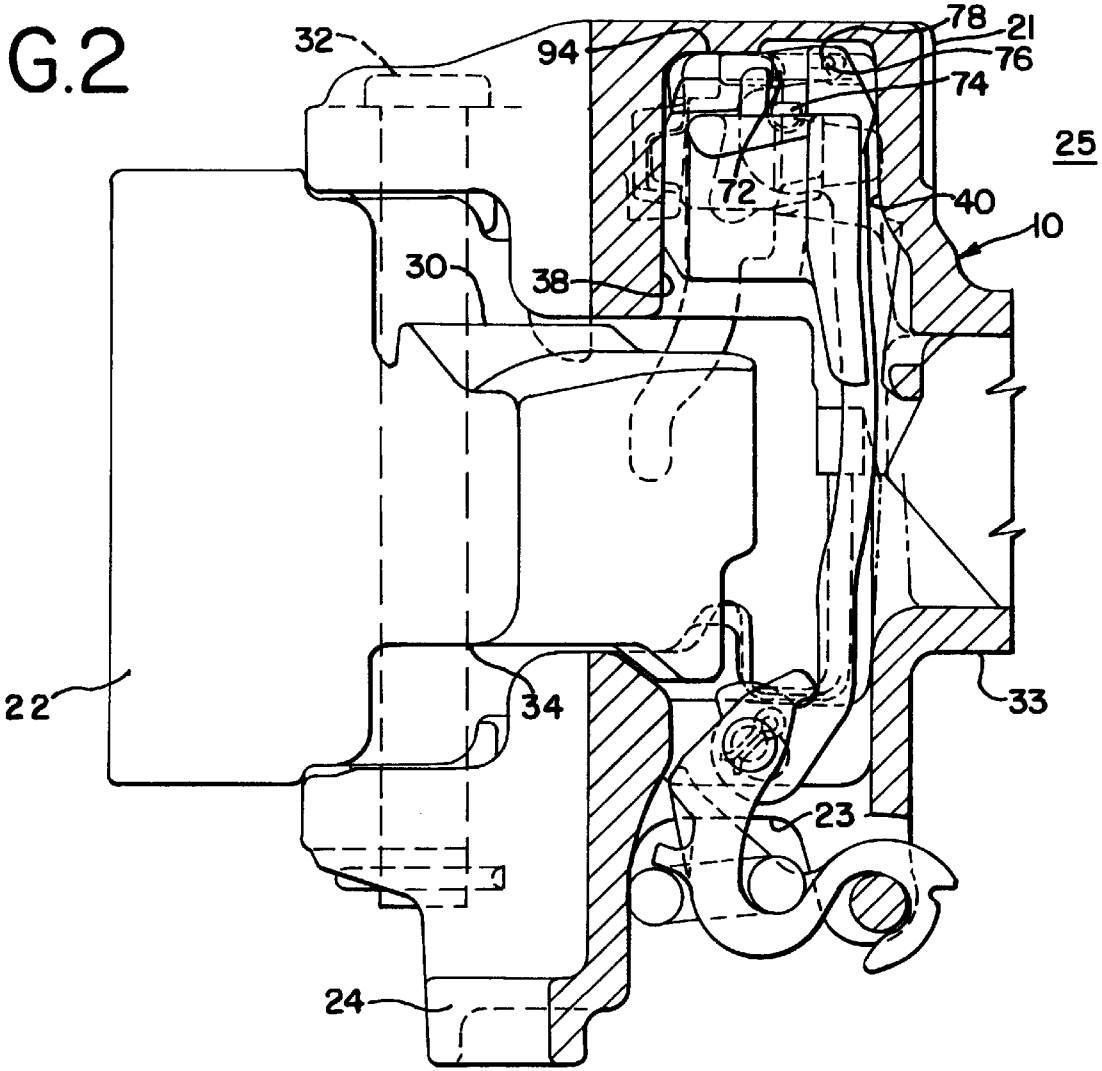
FIG. 2 is a side elevational view in partial cross-section of an Alliance coupler in an upright orientation with the the knuckle and lock in the open position.
Figure 3:
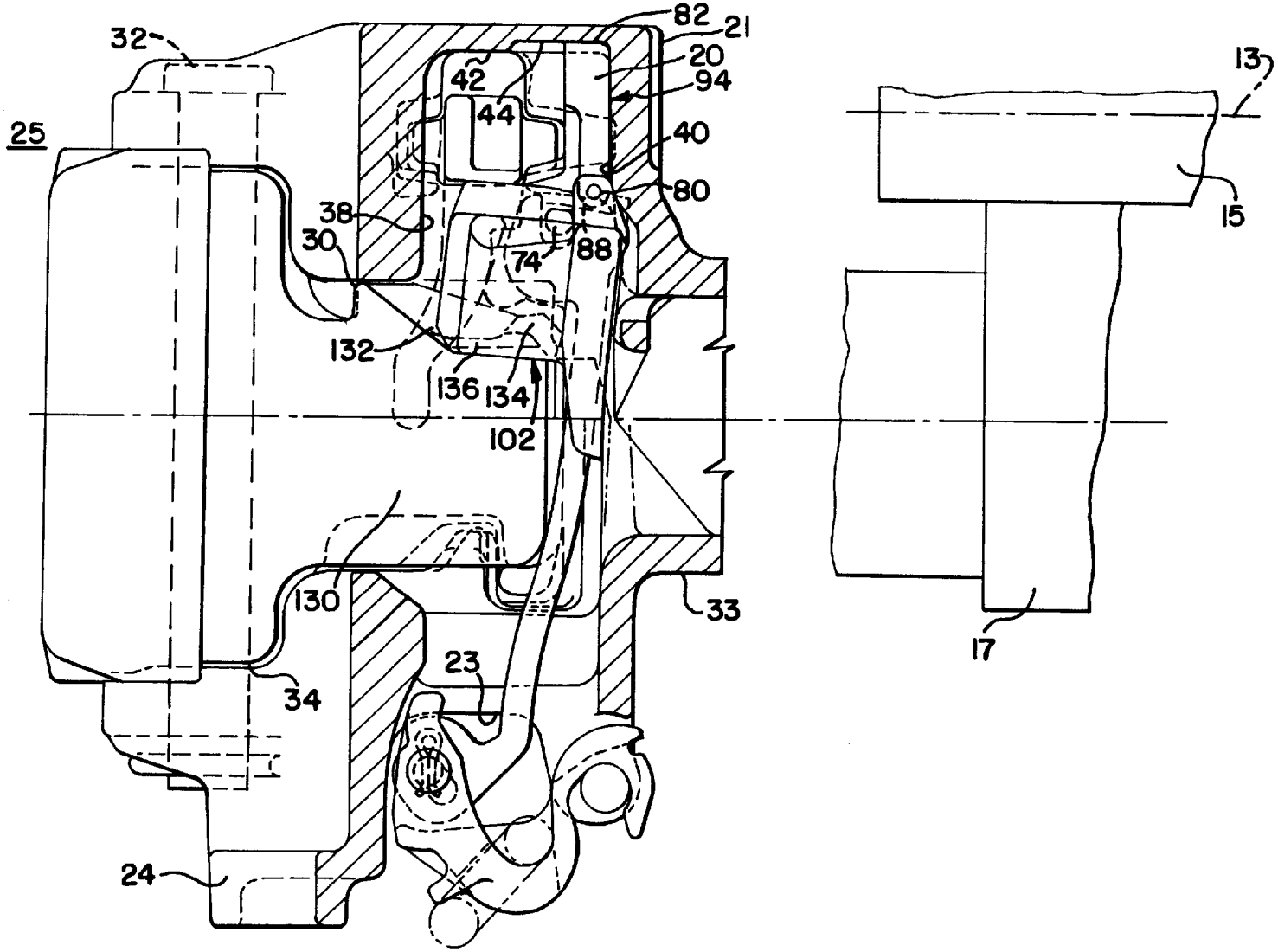
FIG. 3 is a side elevational view in partial cross-section of the Alliance coupler as shown in FIGS. 1 and 2 with the lock partially open and the latch extended to inhibit the lock from unlocking.

In FIG. 1, an Alliance, rotary-dump railcar coupler 25 with head 10, body 11 and internal cavity 12 is shown in partial cross-section. Locklifter 14, lock 16, lock thrower 18 and latch 20 are positioned and operable in cavity 12. Knuckle 22 at the first or forward end 24 of coupler head 10 is noted in the locked or coupled position. In FIGS. 1 to 3, knuckle 22 is vertically positioned approximately centrally about coupler longitudinal axis 26. Coupler 10 is connected at coupler rearward end 33 to draft gear system 17, and coupler axis 26 is generally parallel with longitudinal axis 13 of railcar 15 at an as-assembled and reference position.

Knuckle 22 in FIGS. 2 and 3 has rear pivot arm 30 with pivot pin 32 shown in dashed outline and extending through aperture 34 in rear arm or corner 30 for pivotal operation of knuckle 22 between an open-uncoupled position and closed-coupled position.

Internal lock cavity or chamber 12 includes forward wall 38, rear wall 40 and upper wall 42 at coupler top 21, which cavity 12 has a volume to house lock 16, locklifter 14, lock 16, lock thrower 18, latch 20 and knuckle rear arm 30. Locklifter 14, lock thrower 18, latch 20 and rotor 60 broadly cooperate to provide a locklift assembly 19. In FIGS. 1 to 3, rear wall 40 is in proximity to upper wall 42, which has indentation 44 to receive latch 20 with wall thickness 35 in FIG. 5 at a coupler inverted state to secure coupler 10 in a closed-coupled status at such inverted position.

Figure 4:
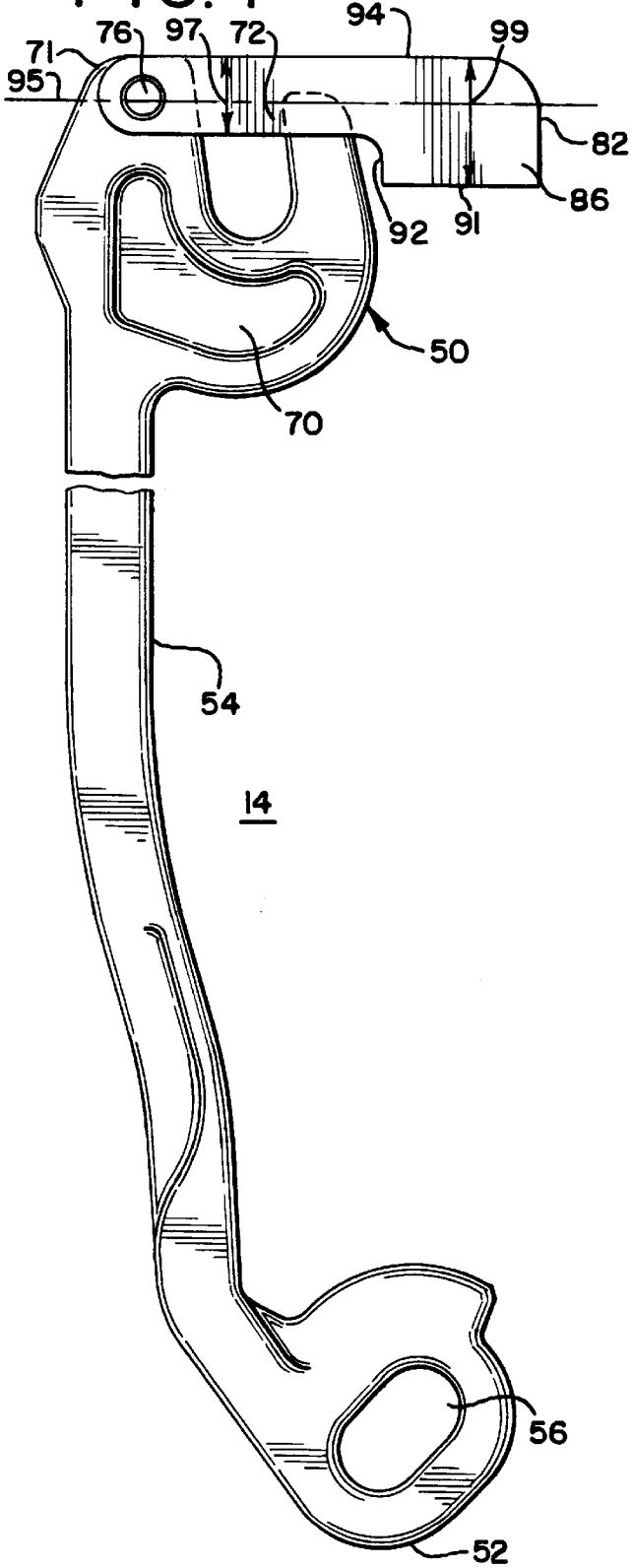
FIG. 4 is an elevational view of the single piece locklifter as noted in FIGS. 1 to 3.
Figure 5:
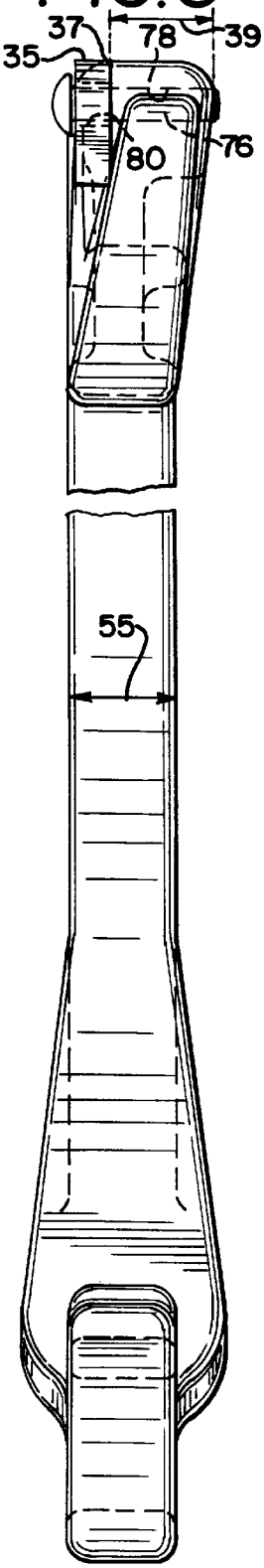
FIG. 5 is a side view of the of the locklifter shown in FIG. 5.

Locklifter 14 in FIGS. 4 and 5 has upper end 50, lower end 52 and elongate connecting arm 54 with wall thickness 55 extending between upper and lower ends 50, 52. Aperture 56 at lower end 52 receives drive pin 58, which connects locklifter 14 to locklift rotor assembly 60, as noted in FIGS. 1 to 3. Rotor assembly 60 in coupler bottom 23 is rotatable to open or close coupler 10 and includes U-shaped arm 62 with cavity or passage 64 to receive pivot pin 66 for pivotal rotation of rotor 60 between a coupler open and closed position. Anti-creep protuberance or shoulder 68 of U-shaped arm 62 contacts the underside of the abutment of the coupler head to inhibit excess rotation of rotor 60 thereby preventing inadvertent uncoupling of coupler 10.

Locklifter upper end 50 includes a first and closed slot 70 in the body of upper end 50. Second U-shaped slot 72 is open at top 71 of locklifter 14 to receive arm or finger 74 of lock thrower 18. In FIGS. 1 to 5, crosspin 76 extends through bore 78 at locklifter upper end 50 and aperture 80 of latch 20, which allows pivotal rotation of latch 20 about crosspin 76.

Figure 7:
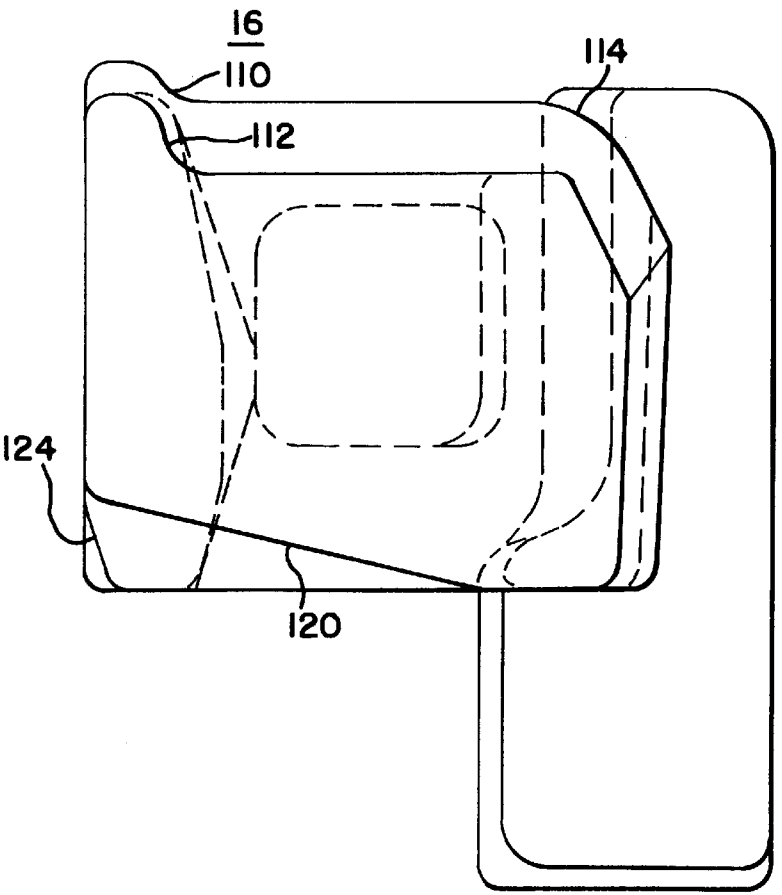
FIG. 7 is a rear view of the lock in FIG. 6 taken along the line 7—7 in FIG. 6.
Figure 6:
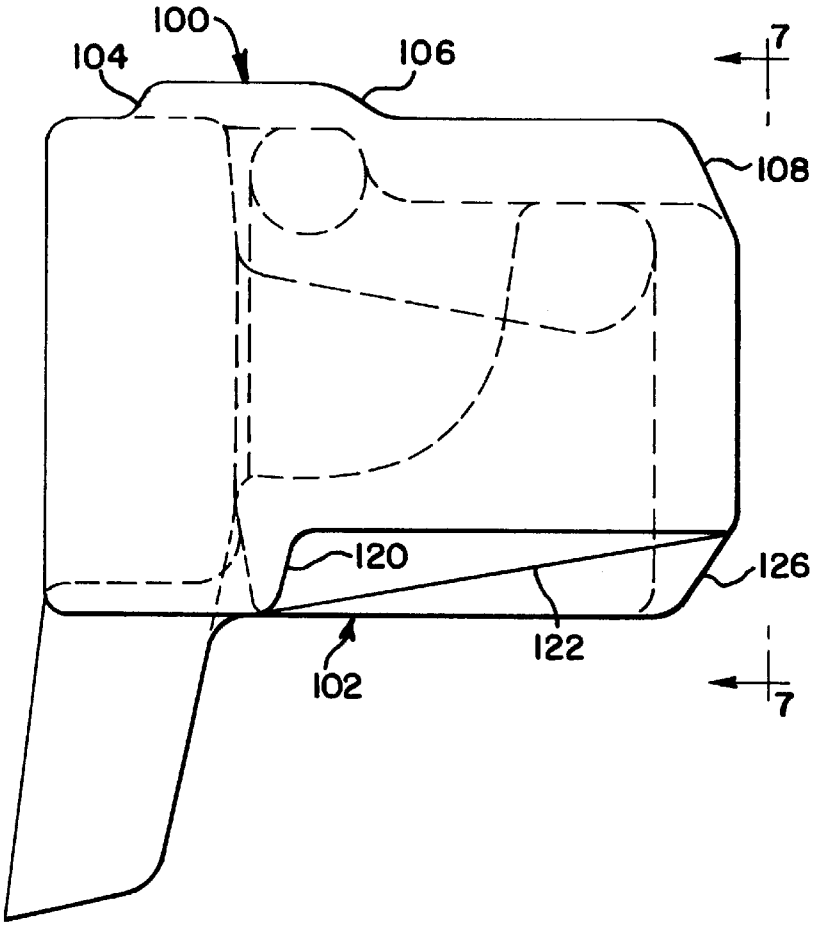
FIG. 6 is a side view of the lock in FIG. 1.
Figure 9:
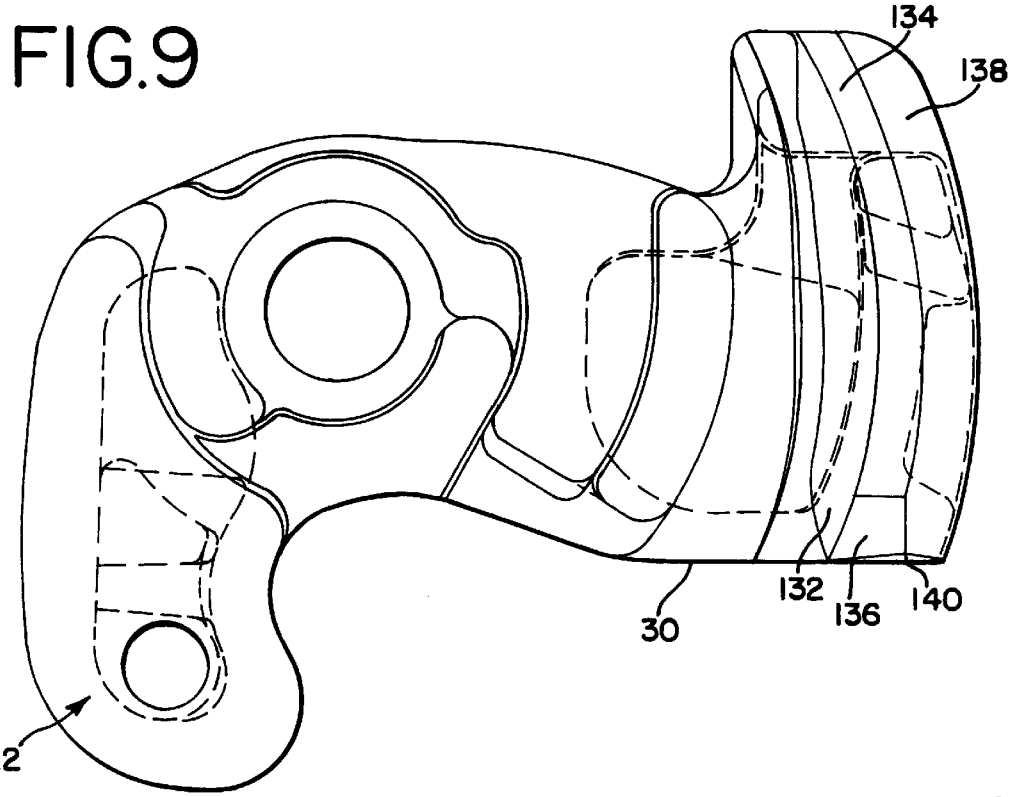
FIG. 9 is a top view of the knuckle in FIG. 8 taken along the line 9—9 in FIG. 8.
Figure 8:
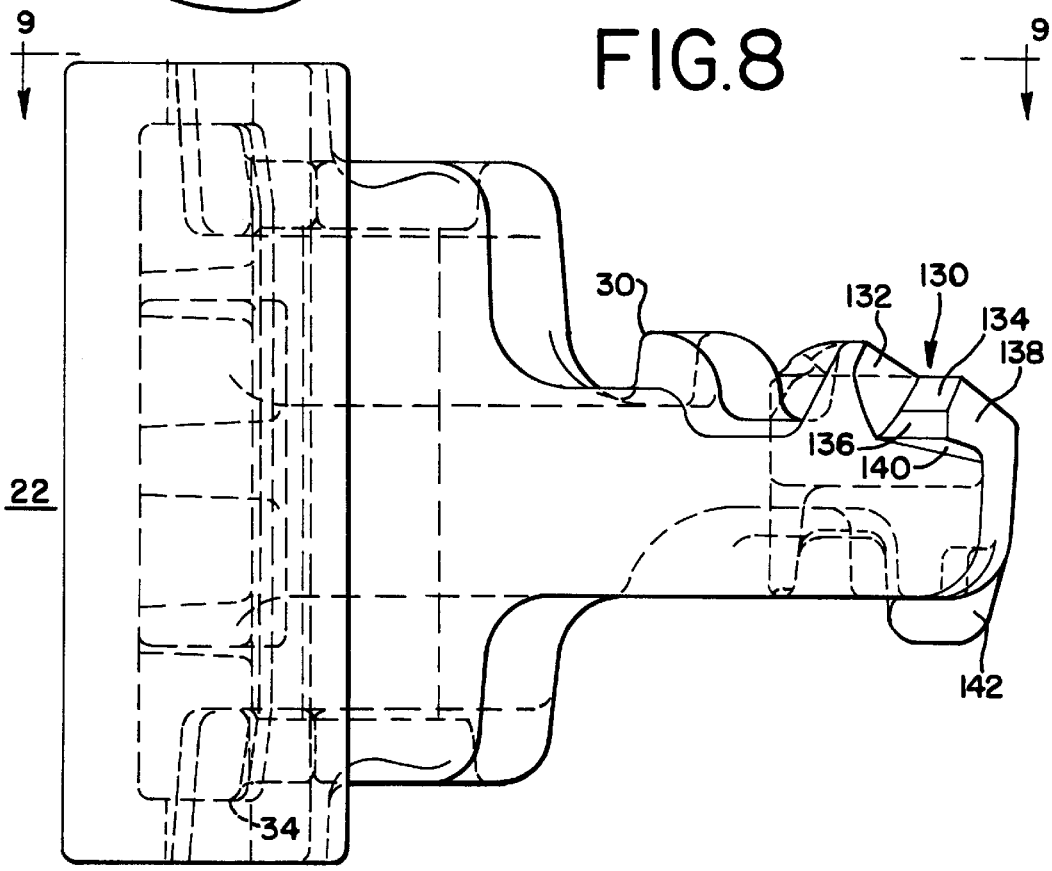
FIG. 8 is a side view of the knuckle in FIG. 1.

A plurality of ramped or sloped surfaces at upper surface 100 and lower surface 102 of lock 16 are noted in FIGS. 1–3, but surfaces 100 and 102 are more clearly illustrated in FIGS. 6 and 7. In these figures, upper surface 100 has sloped and curved contours 104, 106, 108, 110, 112 and 114. Similarly, lower surface 102 includes sloped and curved surfaces 120, 122, 124 and 126. The sloped surfaces 104 to 114 at upper surface 100 interact with locklifter 14 and thrower 18 during the release and opening operation of coupler knuckle 22. Sloped surfaces 120 to 126 of lower surface 102 interact with the curved and camlike surfaces 132, 134, 136, 138 and 140 at the back side 130 of rear corner 30 of knuckle 22, which curved surfaces are noted in FIGS. 8 and 9. The interaction during movement of the contacting components 14, 16 or 18 and, the related upper sloped surfaces 104 to 114 and lower sloped surfaces 132 to 140, allows translation of the motion of locklifter 14, lock 16 and thrower 18 to permit opening and closing of coupler knuckle 22, which is known in the art.

In FIG. 1, coupler 10 is shown with lock 16, knuckle 22 thrower 18 and locklifter 14 in the locked position. In this coupler-locked state, lower sloped surfaces 120 to 126 of lock 16 are positioned below the camlike or sloped surfaces 132, 134 and 136 of knuckle 22. Latch 20 in FIG. 1 is at a reference position with coupler 10 in its normal operational mode for locked coupler 25. In FIG. 2, locklifter 14 has been elevated to engage and raise lock 16 and thrower 18, which movement of locklifter 14 moves and rotates thrower 18 to an open position. Lock 16 is also moved vertically upward to provide lower surface 102 above knuckle surfaces 132, 134 and 136 in FIG. 2, which permits knuckle 22, and thus coupler 10, to move to an open position. In this coupler open position, upper surface 94 of latch 20 contacts or is in close proximity to upper wall or roof 42. Mechanical opening of coupler 10 is generally accomplished by rotation of rotor 60 to elevate locklifter 14 with lock 16 and thereafter moving thrower 18, which permits opening-uncoupling of coupler 10. This mechanical coupler-opening action would be provided in the normal or reference orientation of coupler 10 noted in FIGS. 1 to 3.

Latch 20, as noted in FIGS. 1 to 3, has a generally elongate shape with aperture 80 at first end 88 and lip or protuberance 86 at second end 82, which ends are joined by upper surface 94 having longitudinal axis 95, which axis 95 is seen in FIG. 4 and generally extends parallel to axes 13 and 26. Latch or latch arm 20, as shown in FIG. 5, is pivotally positioned in notch 37 at locklifter upper end 50 with pin 76 extending into or through locklifter upper end wall thickness 39. This elongate shape of latch 20 is noted on edge in FIG. 5 wherein wall thickness 35 of latch 20 is less than the width or wall thickness 39 or 55 of locklifter 18. Latch lower edge 90 extends from second end 82 toward first end 88 and intersects lip 86 at shoulder 92. Lip 86 has second lower edge 91 extending from shoulder 92 to second end 82. Latch 20 has a first face height 97 between lower edge 90 and upper surface 94, and second face height 99 between lip lower edge 91 and upper surface 94.

Latch 20 is freely pivotable about crosspin 76 at rotation about longitudinal axis 26 of coupler 25 and its attached railcar 15. As latch 20 pivots on crosspin 76, it is vertically extended from and perpendicular to axis 26, which allows latch upper surface 94 to contact rear wall 40 with second end 82 contacting indentation or recess wall 44, as noted in FIG. 3. Latch 20 maintains lock lower surface 102 at a vertical position below knuckle sloped surfaces 132, 136 and 134, in this illustration of coupler 10 in FIG. 3. This arrangement of the wall and sloped surfaces inhibits rotation of thrower 18 and restricts the movement of lower surface 102 of lock 16 past sloped surfaces 132, 134 and 136 of knuckle 22, which limits the movement of knuckle 22 and maintains coupler 10 in the locked state. Lip 86 has a length larger than the arm length connected to pin 76, and the larger mass provides a mechanical mass to move arm 20 into the lock contacting position noted in FIG. 1 when the coupler is at a reference state.

The illustration in FIG. 3 shows coupler 10 in the vertically upright position, although latch 20 is normally operable with coupler 10 in an inverted position. This exemplary upright illustration in FIG. 3 is provided to consistently illustrate the positional relationship of the various components relative to the reference position noted in FIG. 1 and is not an operational limitation. The operation of latch 20 is only required to maintain locklifter 18 against movement to a coupler-open position. Therefore, a latch 20 of a large mass is not required to provide the requisite mechanical operation. The present invention provides ease of assembly and operation, low cost and mechanical locking against inadvertent uncoupling of coupler 10 during its inverted operation.

While this invention has been described in connection with a specific embodiment thereof, it is to be understood that this is by way of illustration and not by way of limitation. The scope of the appended claims should be construed as broadly as the prior art will permit.

I claim:

1. In a rotary coupler for a railcar, which coupler is operable between a coupled and uncoupled state, said railcar having a first longitudinal axis, said coupler having a second longitudinal axis, said first axis and said second axis about parallel at an as assembled and reference position, said railcar being upright at said reference position, said railcar and coupler rotatable between said upright position and an inverted position, said coupler having a coupler head, said coupler head having a top., a bottom and a lock cavity, a knuckle with at least one knuckle corner with a backside, said corner backside positioned in said lock cavity, and a locklift assembly, said locklift assembly having a lock thrower, a lock with an upper surface, a rotor and a locklifter with a latching apparatus for prevention of uncoupling of said coupler at said inverted position, said latching apparatus comprising:

an arm latch having a third longitudinal axis, a first end and a second end, said arm latch defining a generally horizontal aperture transverse to said third axis at one of said first end and second end;

said coupler having a forward end and a rearward end aligned with said second longitudinal axis;

said locklifter having an upper end and a lower end, which locklifter is generally vertically aligned in said lock cavity with said upper end in said cavity and said lower end extending below said coupler bottom for mating with said rotor;

said locklifter defining a bore at said upper end;

a pin;

said aperture of said arm latch and said bore of said locklifter aligned to receive said pin to secure said arm latch for pivotal rotation, which other of said arm-latch first end and second end contacts said lock upper surface at a coupler coupled position;

said lock cavity having a roof wall, said roof wall defining an upper recess to receive said other end of said arm latch, which arm latch is pivotable about said pin from said reference position to a coupler-closed securing position to maintain said locklifter and lock in said coupled position at said coupler and railcar inverted position.

2. In a railroad car rotary coupler latching apparatus as claimed in claim 1, wherein said arm latch defines a protuberance at said arm latch other end to contact said lock upper surface.

3. In a railroad car rotary coupler latching apparatus as claimed in claim 2, wherein said lock thrower has an extending finger, said locklifter upper end defining a U-shaped slot with a slot depth to receive said knuckle thrower finger, said arm latch having a predetermined length, said arm latch pivotable about said pin at said coupler inverted position to extend said arm latch to nest in said upper recess and maintain said locklifter in said reference position, to retain said finger in said U-shaped slot at said inverted coupler state, to inhibit rotation of said lock thrower and, to maintain said lock, knuckle and coupler in said closed position.

4. In a railroad car rotary coupler latching apparatus as claimed in claim 2, said latch arm operable between an inoperable state at a coupler upright position, and an operable position to contact said upper-wall recess at a coupler inverted position.

5. In a railroad car rotary coupler latching apparatus as claimed in claim 2, wherein an AAR standard coupler of at least one of an E style coupler and an F style coupler defines a first lock cavity with a first volume, said coupler lock cavity having a second volume less than said standard coupler first volume.

6. In a railroad car rotary coupler latching apparatus as claimed in claim 1, wherein said arm latch has an elongate upper surface, a first lower edge with a first length, and said protuberance has a second lower edge with a second length, said first length cooperates with said elongate upper surface to define a first height, and said second length cooperates with said upper surface to define a second height greater than said first height, said second height operable to contact said lock upper surface at said reference position, which second length and second height cooperate to provide said protuberance with a mass greater than a mass at an area bounded by said first length and first height to promote latch arm movement from said coupler-closed securing position to said reference position.

7. In a railroad car rotary coupler latching apparatus as claimed in claim 1, wherein said locklifter has an arm extending between said upper end and said lower end; said locklifter arm having a wall with a first wall thickness; said locklifter upper end defining a notch and a second arm wall thickness at said upper end; said latch arm having a third wall thickness less than any of said first wall thickness and second wall thickness.

* * * * *